US005185978A

United States Patent [19]

Sasaki

[11] Patent Number: 5,185,978

[45] Date of Patent: Feb. 16, 1993

[54] PLACE-ON TYPE ASSEMBLABLE STRUCTURE

[75] Inventor: Mitsuo Sasaki, Yamato, Japan

[73] Assignee: Just Japan Co., Ltd., Tokyo, Japan

[21] Appl. No.: 670,261

[22] Filed: Mar. 8, 1991

[30] Foreign Application Priority Data

Mar. 20, 1990 [JP] Japan ..... 2-68349

[51] Int. Cl.[5] ..... E04H 6/42

[52] U.S. Cl. ..... 52/175; 414/227; 414/261

[58] Field of Search ..... 52/167 DF, 125.2, 175, 52/301, 252, 263, 283, 645, 648, 280, 169.6; 414/234, 227, 261

[56] References Cited

U.S. PATENT DOCUMENTS

| | | | |
|---|---|---|---|
| 3,190,467 | 6/1965 | English | 414/234 |
| 4,747,242 | 5/1988 | Aarstad | 414/227 X |
| 4,800,694 | 1/1989 | Sasaki . | |
| 4,804,307 | 2/1989 | Motoda | 52/169.6 X |
| 5,018,726 | 5/1991 | Sternad | 414/234 X |

*Primary Examiner*—David A. Scherbel
*Assistant Examiner*—Creighton Smith
*Attorney, Agent, or Firm*—Beveridge, DeGrandi, Weilacher & Young

[57] ABSTRACT

A place-on type assemblable structure includes a foundation beam and an assembly body assembled on the foundation beam. The foundation beam is placed on the surface of the ground via a pluarlity of jack means provided for the fondation beam. The level of the foundation beam can be easily adjusted by extending and contracting the jack means.

12 Claims, 15 Drawing Sheets

PLACE-ON TYPE ASSEMBLABLE STRUCTURE

FIELD OF THE INVENTION

This invention relates to a place-on type assemblable structure which is not secured to the ground.

DESCRIPTION OF THE PRIOR ART

Generally, structures such as a two-storied parking lot have foundation portions that are secured onto the ground (land) and are constructed semi-permanently.

In the case of such a semi-permanent structure, however, the foundation portion that serves as a groundsill must be firmly secured onto the ground and it requires, as a whole, a large-scale construction work, an increased cost of construction, and a prolonged period of construction. Furthermore, in case where it is desired to use the land for another purpose, the structure built on it must be broken down. This is the waste of the construction cost paid with much effort and requires additional cost of breaking down.

In order to solve the above-mentioned problems, Japanese Patent Laid-Open Publication No. 244940/1987 (U.S. Pat. No. 4,800,694 and U. K. Patent 2,189,274) discloses a place-on type assemblable structure that can be assembled and disassembled, and that can be utilized again without being scrapped.

The place-on type assemblable structure includes a base plate placed on a substantially flat surface and assembly elements having pillars that upwardly extends from the base plate, and is constructed such that the vertical load exerted on the pillars of the assembly elements is substantially supported by the base plate. Unlike the prior art, therefore, the pillars need not be secured to the ground; i.e., there is obtained a place-on type assemblable structure which can be assembled and disassembled, and can be utilized again without being scrapped. The place-on type assemblable structure has been widely put to practical use for building, for example, three-dimensional parking lots.

The above-mentioned place-on type assemblable structure can be simply placed on the ground. Therefore, no construction work is required at all to construct the foundation portion in the ground for securing the structure.

However, when the ground on which the structure is to be placed is soft or is a rough terrain having extreme difference in the height or unevenness, it is necessary to prepare the ground prior to assembling the structure so as to fully withstand the own weight of the structure as well as the loads to be exerted on it, and to prevent the structure from being tilted or deformed. That is, the ground should be leveled by lime treatment and levelling pavement, for example, to prepare a substantially flat ground surface with the required bearing power.

When the place-on type assemblable structure mentioned above is used for building a structure having a place-on type space of a relatively wide area such as the structure for three-dimensional parking lot, no particular problem is encountered even when the ground has a grade to some extent. In preparing the ground, therefore, not so high accuracy is required in regard to leveling the grade.

However, when the place-on type assemblable structure is used for building a structure having a place-on space of a narrow area such as a left structure for lifting up and down vehicles and requires a high degree of safety, strict accuracy is required in regard to leveling the grade.

Therefore, when a place-on type assemblable structure for lifting up and down vehicles is to be placed as part of the structure for three-dimensional parking lot, the ground of a portion where there will be placed the place-on type assemblable structure for lifting up and down vehicles must be leveled with strict accuracy prior to placing the place-on type assemblable structure. Therefore, the leveling work becomes complex, an increased cost is required for the construction, and the period of construction is prolonged. This impairs distinguished merits of the above-mentioned place-on type assemblable structure, and improvement on the structure has been desired.

SUMMARY OF THE INVENTION

The principal object of this invention, therefore, is to provide an improved place-on type assemblable structure, of which the level-adjustment can be made easily and reliably without necessity for carrying out the construction for leveling the ground with particularly strict accuracy, and which has excellent bearing power of the ground.

In order to accomplish the above-mentioned main object according to this invention, there is provided a place-on type assemblable structure comprising a foundation beam and an assembly body assembled on said foundation beam, wherein said foundation beam is provided with a plurality of jack means and is placed on the surface of the ground via said jack means, and the level thereof is adjusted by extending and contracting said jack means.

According to this invention, furthermore, there is provided a place-on type assemblable structure for lifting up and down vehicles, which is independently placed on the surface of the ground as part of the vehicle-parking structure that has parking floors on the first floor and on the second floor, said place-on type assemblable structure for lifting up and down vehicles comprising an assemblable structure placed on the surface of the ground and a pallet that is supported in said assemblable structure and is allowed to move up and down between the first floor and the second floor; wherein said assemblable structure includes a substantially rectangular foundation beam and an assembly body assembled on said foundation beam;

said foundation beam is provided with a plurality of jack means; and said foundation beam is placed on the surface of the ground via said jack means, and the level thereof is adjusted by extending and contracting said jack means.

The other objects and features of the invention will become obvious from the detailed description of the specification by reference to the accompanying drawings.

DETAILED DESCRIPTION OF THE PREFERRED EMBODIMENTS

The place-on type assemblable structure improved according to this invention will now be described in detail by way of embodiments by reference to the accompanying drawings.

Figure 1:
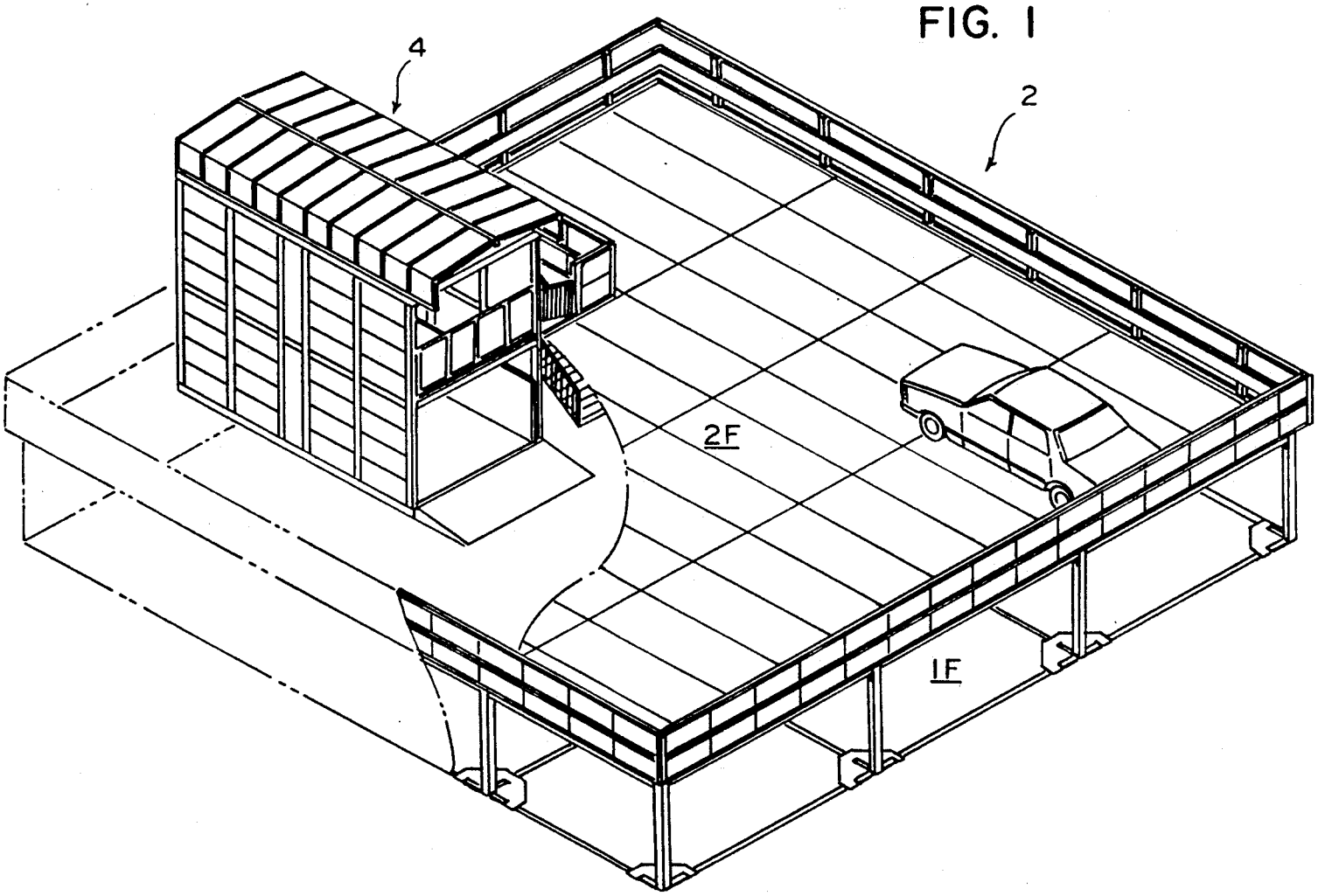
FIG. 1 is a perspective view which schematically a structure for three-dimensional parking lot equipped with a place-on type assemblable structure for lifting up and down vehicles according to an embodiment of this invention.
Figure 4:
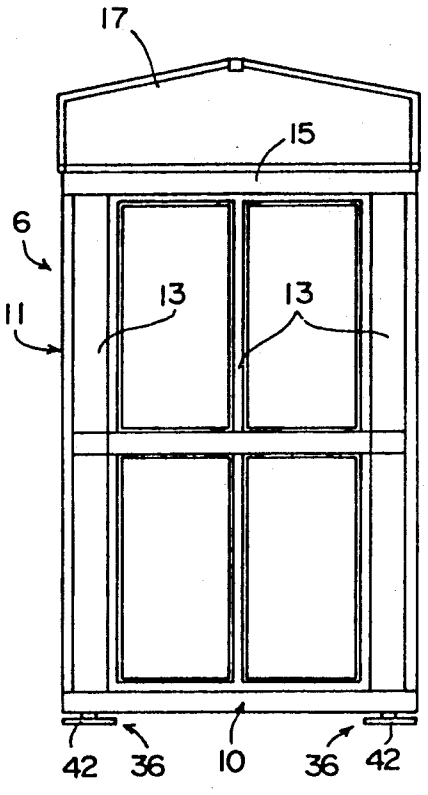
FIG. 4 is a view showing the rear side of FIG. 2.
Figure 3:
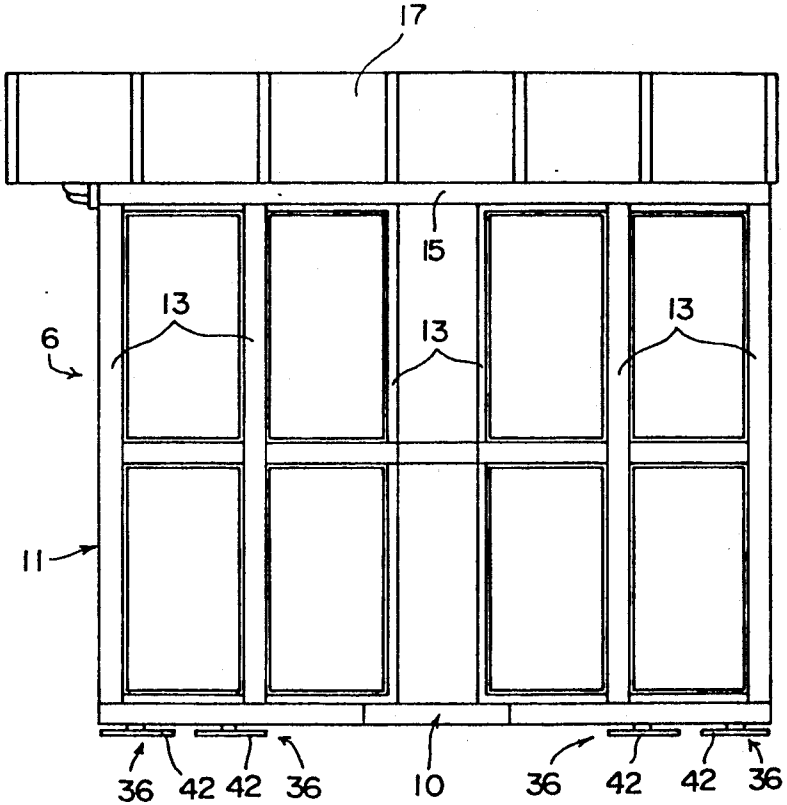
FIG. 3 is a view showing the right side of FIG. 2.

FIG. 1 shows the state where a place-on type assemblable structure 4 for lifting up and down vehicles is placed on the surface of the ground as part of the (three-dimensional parking) structure 2 for parking vehicles having parking floors 1F and 2F on the first floor and on the second floor, the place-on type assemblable structure 4 for lifting up and down vehicles being placed independently from the structure 2 for parking vehicles. The first floor 1F is the ground which is prepared and paved to be substantially flat.

The structure 2 for parking vehicles is placed and assembled on the ground in accordance, for example, with the place-on type assemblable structure disclosed in Japanese Patent Laid-Open Publication No. 244940/1987 (U.S. Pat. No. 4,800,694 and U. K. Patent 2,189,274) or the assemblable structure disclosed in Japanese Patent Laid-Open Publication No. 96038/1990 that were proposed by the present applicant.

The place-on type assemblable structure 4 for lifting up and down vehicles is placed on the area of the structure 2 for parking vehicles. Therefore, the structure 2 for parking vehicles is provided with space for accommodating the place-on type assemblable structure 4. The place-on type assemblable structure 4 and the structure 2 for parking vehicles are placed on the surface of the ground independently from each other, i.e. without being secured to each other.

As shown in FIGS. 2 to 5, the place-on type assemblable structure 4 comprises an assemblable structural body 6 that is placed on the surface of the ground and a pallet 8 that is supported in the assemblable structural body 6 to move up and down between the first floor and the second floor.

The assemblable structural body 6 includes a substantially rectangular foundation beam 10 and an assembly body 11 that is assembled on the foundation beam 10. The assembly body 11 includes pillar portions 13 secured onto the foundation beam 10, a ceiling beam 15 supported on the pillar portions 13, and a roof 17 supported on the ceiling beam 15.

Figure 10:
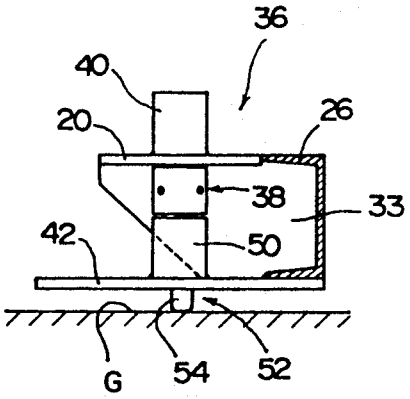
FIG. 10 is a sectional view taken along the line X—X of FIG. 9.

The foundation beam 10 is composed, as shown in FIGS. 6 to 10, of two foundation beam blocks having substantially the same constitution, i.e., a front-side foundation beam block 12, a rear-side foundation beam block 14, and a pair of intermediate beams 16 and 18 that couple them together, and has a rectangular shape as a whole. The beams forming the rectangular shape have a channeled-shape in cross section as shown in FIG. 10.

The front-side foundation beam block 12 will be described, first. On the inside of the front-side foundation beam block 12, support plates 20 and 22 are fastened, by welding, to the side beams 26 and 28 so as to extend from a front end beam 24 toward the intermediate beams 16 and 18 along both side beams 26 and 28. The upper surfaces of the support plates 20, 22 and of the beams 24, 26 and 28 are substantially flush with each other.

Figure 6:
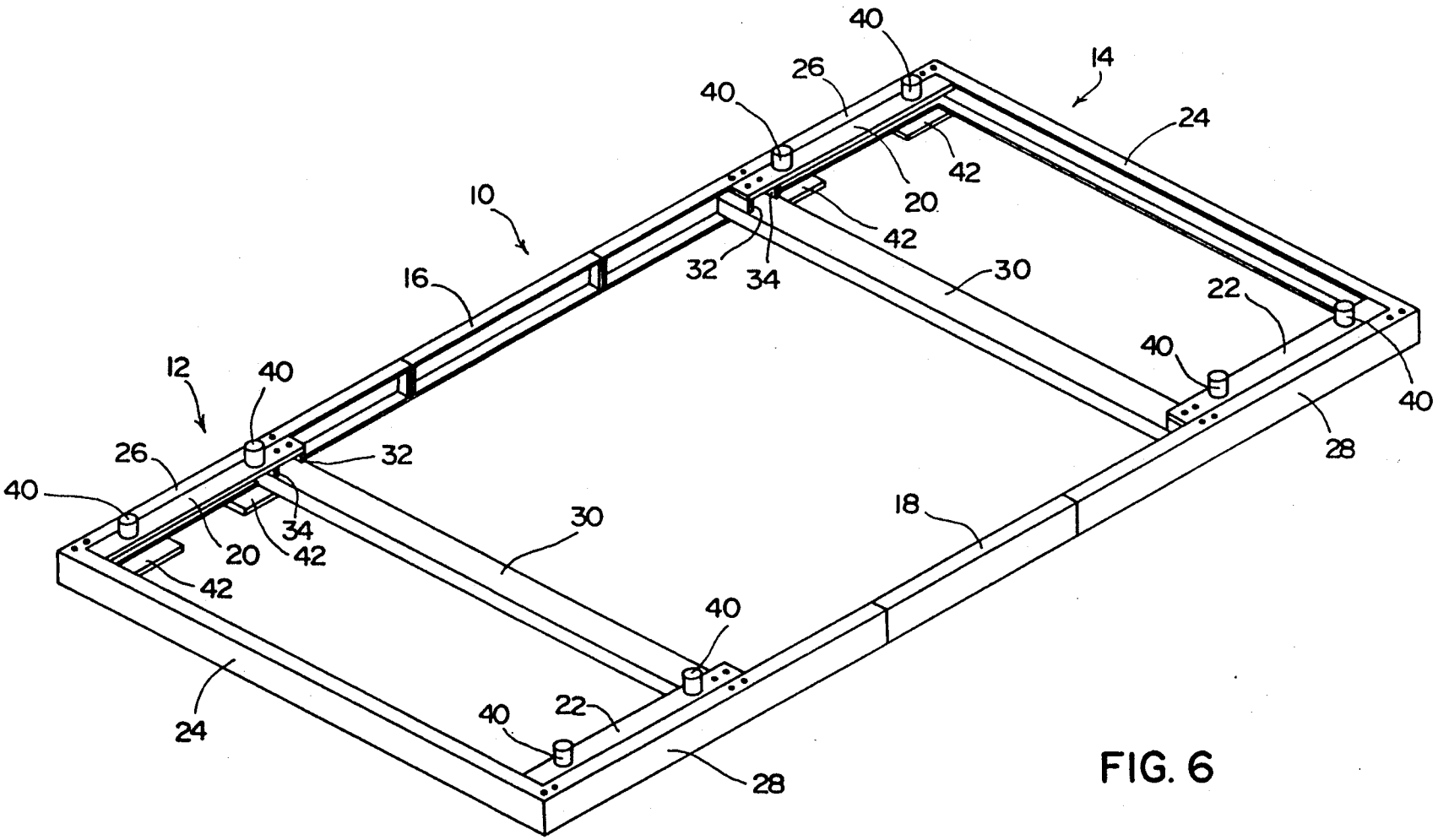
FIG. 6 is a perspective view showing a foundation beam of FIG. 5.
Figure 7:
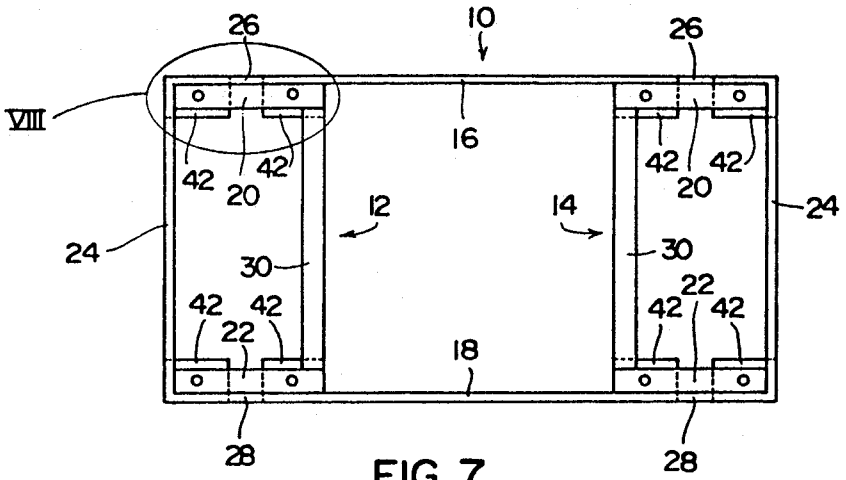
FIG. 7 is a top view of FIG. 6.
Figure 8:
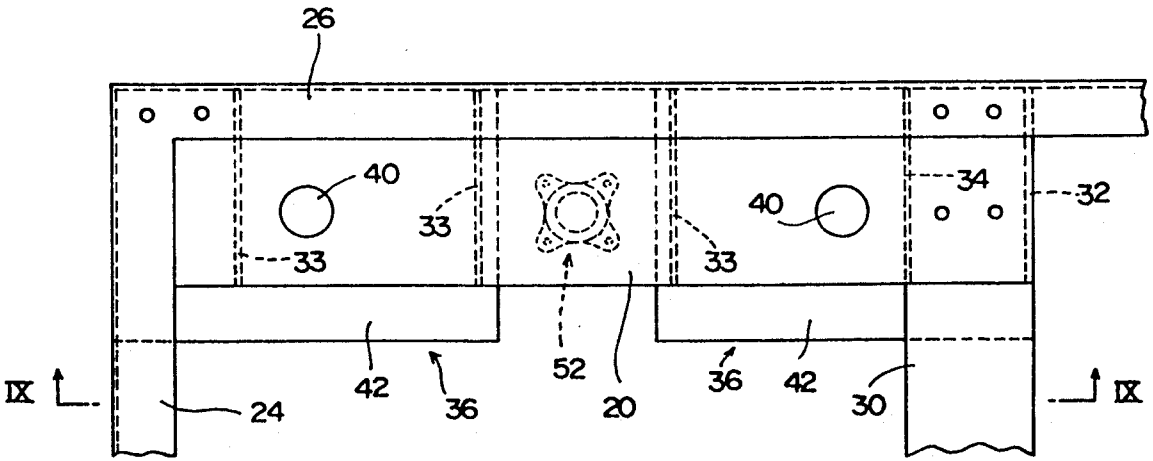
FIG. 8 is a view showing a portion VIII of FIG. 7 on an enlarged scale.
Figure 9:
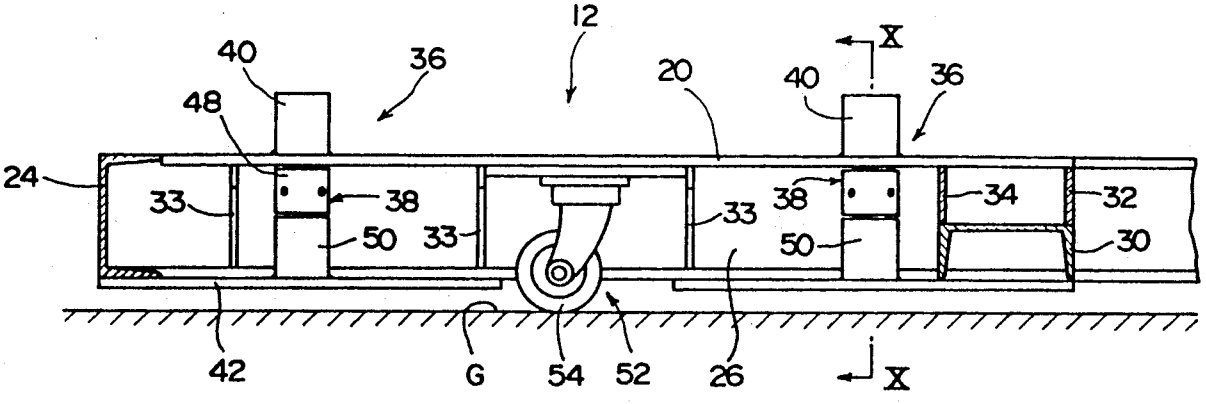
FIG. 9 is a sectional view taken along the line IX—IX of FIG. 8.

A lateral beam 30 having a channeled-shape in cross section stretches astride the two side beams 26 and 28, and its both ends are fastened to these beams. Near both ends of the lateral beam 30, a pair of rectangular support plates 32 and 34 are secured along with the lateral beam 30 maintaining a distance from each other (only one end is seen in FIG. 6). The ends of the support plates 20 and 22 are further secured to the upper ends of the support plates 32 and 34. As shown in FIGS. 8, 9 and 10, reinforcing plates 33 are fastened at three places between the lower side of the support plates 20, 22 and the two side beams 26, 28.

The front-side foundation beam block 12 is further provided with jack means 36 at four places. The jack means 36 are attached to the support plates 20 and 22 respectively at two places.

The jack means 36 will now be described. The jack means 36 have all the substantially same constitution, and only one of them will be described below. As shown in FIG. 9, the jack means 36 includes an operation member 38, an internal thread portion 40 formed in the support plate 20, and a base plate 42 to be placed on the surface of the ground.

Figure 11:
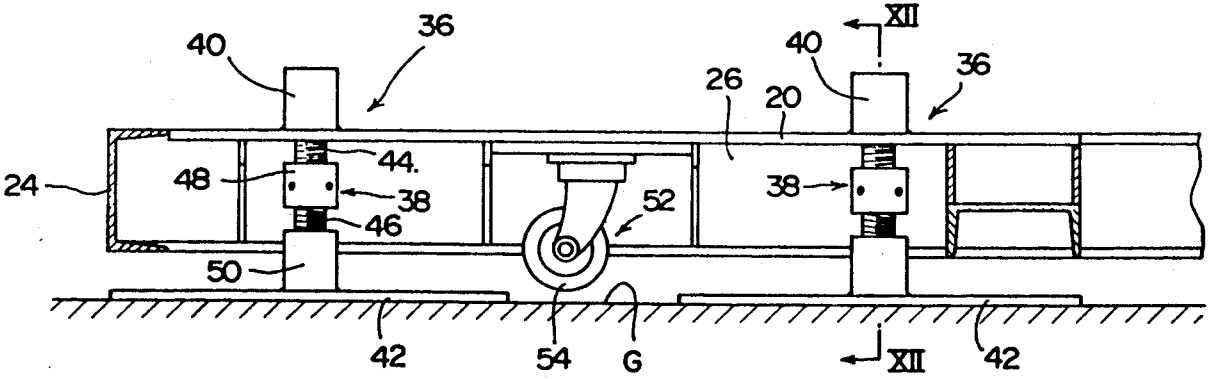
FIG. 11 is a view showing another operation mode of FIG. 9.

The operation member 38 consists of a rod as shown in FIG. 11, has a right-hand thread 44 and a left-hand thread 46 (both being external threads) formed at both end portions thereof, and has a rotary operation portion 48 formed at the central portion thereof. The rotary-operation portion 48 has a cylindrical shape with a diameter greater than that of the thread portion, and further has a plurality of through holes in which will be inserted an operation rod. The rotary operation portion 48 may be constructed in a variety of other ways such as forming the outer periphery thereof simply in a hexagonal shape.

The internal thread portion 40 of the support plate 20 has an internal thread with which will engage with the right-hand thread 44, the internal thread being formed in a cylindrical member that is fastened onto the support plate 20 to extend in a vertical direction and having a closed upper end. Though not diagramed, in the above-mentioned portion of the support plate 20 is formed a through hole having a diameter greater than the internal thread.

The base plate 42 to be placed on the surface of the ground has a rectangular shape and further has a cylindrical portion 50 that is fastened thereto so as to upwardly extend in the vertical direction. In the cylindrical member 50 is formed an internal thread which will engage with the left-hand thread 46.

The right-hand thread 44 of the operation member 38 engages with the internal thread portion 40 of the support plate 20 and the left-hand thread 46 engages with the internal thread of the cylindrical member 50 of the base plate 42, and thus the jack means 36 is provided for the front-side foundation beam block 12. By rotating the operation member 38, the base plate 42 is brought close to, or is separated away from, the front-side foundation beam block 12. That is, the jack means 36 extends and contracts. Under the condition where the jack means 36 is most contracted, as shown in FIGS. 9 and 10, the base plate 42 is at a position intimately contacted to the lower surfaces of the front end beam 24 and the side beam 26.

Castors 52 which constitute running means are provided under the support plates 20 and 22 of the front-side foundation beam block 12 between the jack means 36. When the jack means 36 is under the contracted condition, the wheel 54 of the castor 52 protrudes beyond the lower side surface of the front-side foundation beam block 12 and is contacted to the surface G of the ground as shown in FIGS. 9 and 10.

Figure 12:
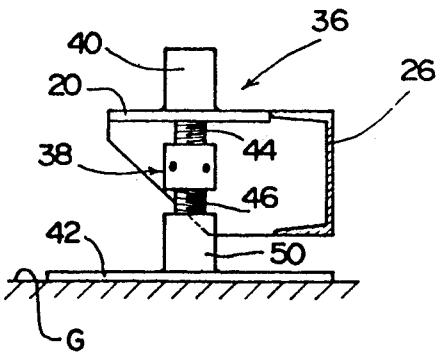
FIG. 12 is a sectional view taken along the line XII—XII of FIG. 11.

When the jack means 36 is extended by a predetermined amount, the base plate 42 downwardly protrudes beyond the wheel 54 of the castor 52 to come in contact with the surface G of the ground as shown in FIGS. 11 and 12.

The rear-side foundation beam block 14 is constituted substantially in the same manner as the front-side foundation beam block 12 mentioned above. Therefore, the same portions are denoted by the same reference numerals, but explanation therefore is omitted here. The beam 24 in the rear-side foundation beam block 14 constitutes the rear end beam.

As described earlier, the foundation beam blocks 12 and 14 are disassemblably coupled together via intermediate beams 16 and 18 using bolts or the like, whereby the foundation beam 10 of a rectangular shape is made up. The intermediate beams 16 and 18 constitute parts of the side beams of the foundation beam 10. The jack means 36 are provided at eight places as a whole but may be provided at four places only.

Figure 13:
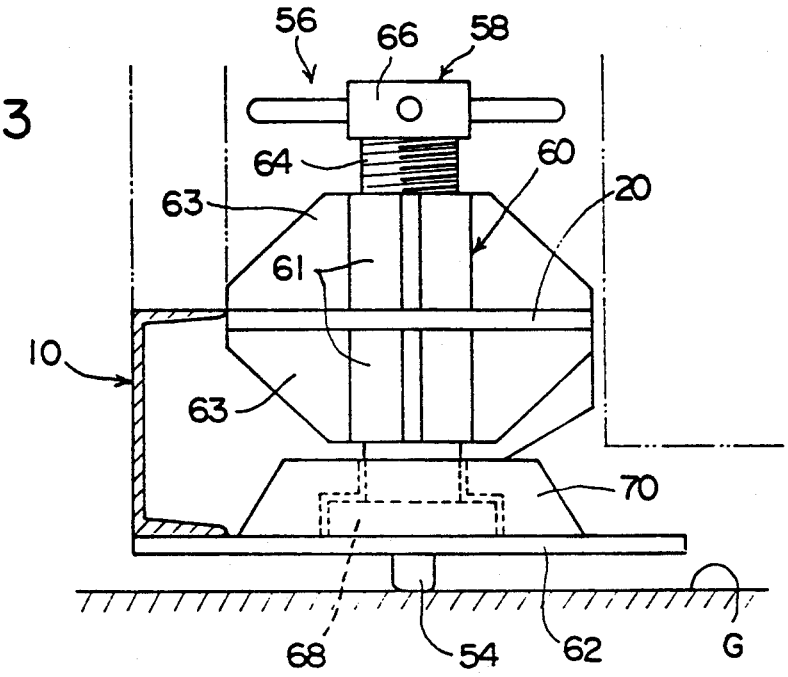
FIG. 13 is a sectional view like FIG. 10 showing another embodiment of jack means.
Figure 14:
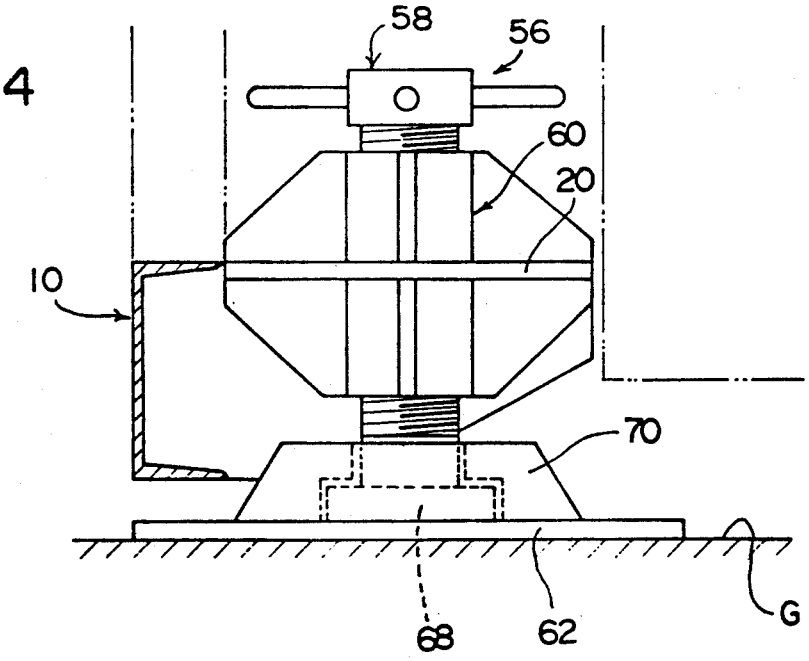
FIG. 14 is a view showing another operation mode of FIG. 13.

FIGS. 13 and 14 illustrate jack means 56 according to another embodiment. The jack means 56 includes an operation member 58, an internal thread portion 60 formed in the support plate 20, and a base plate 62 to be placed on the surface of the ground.

The operation member 58 consists of a rod, and has an external thread 64 at the central portion thereof, a rotary operation portion 66 at one end thereof, and a disk portion 68 at the other end thereof. Both the rotary operation portion 66 and the disk portion 68 have diameters greater than the external thread 64. The rotary operation portion 66 has a plurality of through holes in which will be inserted the operation rods.

The internal thread portion 60 of the support plate 20 has an internal thread that is formed in a cylindrical member 61 that is secured so as to extend in the vertical direction penetrating through the support plate 20. A plurality of reinforcing members 63 are secured between the support plate 20 and the outside of the cylindrical member 61 in the radial direction.

An accommodation/support portion 70 that accommodates and supports the disk portion 68 is formed on the base plate 62 that is to be placed on the surface of the ground.

The external thread 64 of the operation member 58 engages with the internal thread portion 60 of the support plate 20, and the disk portion 68 is rotatably accommodated and supported in the accommodation/support portion 70 of the base plate 62, so that the jack means 56 is provided for the foundation beam 10. By rotating the operation member 58, the base plate 62 is brought close to, or is separated away from, the base beam 10. That is, the jack means 56 extends and contracts. The function of the jack means 56 is substantially the same as that of the aforementioned jack means 36 as will be comprehended from the drawings, and is not described any further.

Figure 5:
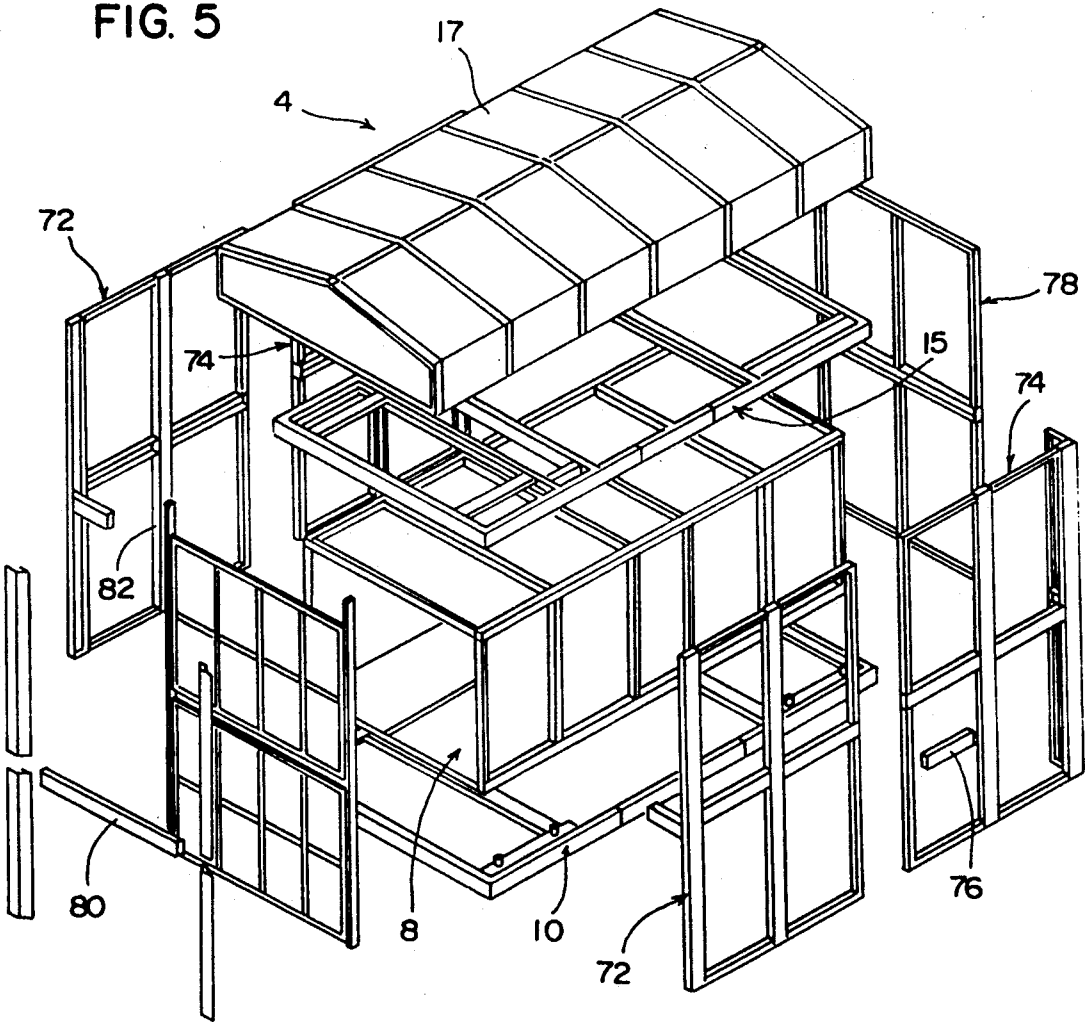
FIG. 5 is a perspective view showing the place-on type assemblable structure of FIG. 1 in a disassembled manner.
Figure 15:
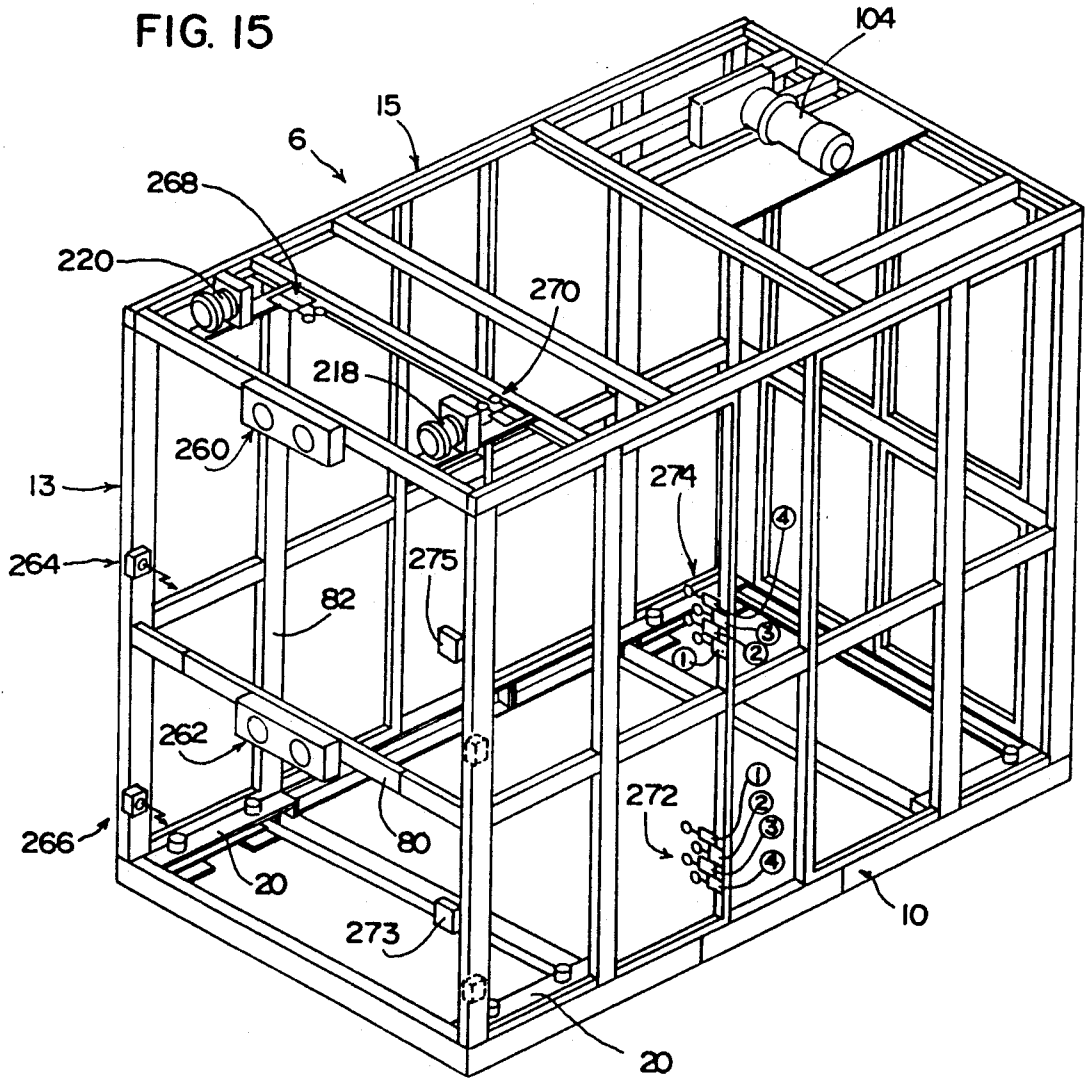
FIG. 15 is a perspective view which schematically shows a portion of the assemblable structure of the above-mentioned embodiment.

As shown in FIG. 15, the pillar portions 13 are secured to the foundation beam 10 to extend upwardly from both sides thereof and from the rear portion thereof. As shown in FIG. 5, the pillar portions 13 are constituted by side front pillar blocks 72 and side rear pillar blocks 74 on both sides, and side intermediate beams 76 for coupling them together. Further, the rear portion is chiefly constituted by a rear end pillar block 78. The front portion is chiefly constituted by a front intermediate beam 80 that couples the side front pillar blocks 72 at middle portions thereof in the up-and-down direction. The pillar portions 13 consisting of these elements are disassemblably assembled on the foundation beam 10.

Figure 16:
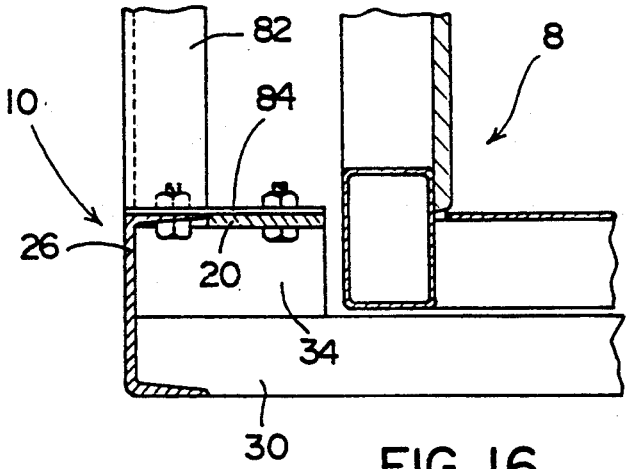
FIG. 16 is a sectional view showing a condition where the foundation beam and the pillars are coupled together according to the above-mentioned embodiment.
Figure 17:
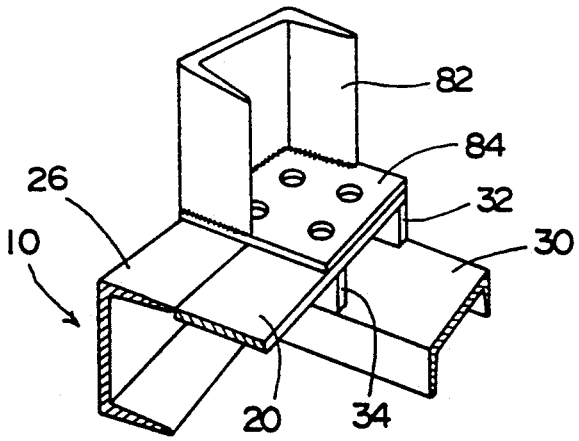
FIG. 17 is a perspective view showing a part of FIG. 16.

FIGS. 16 and 17 illustrate a fastening means for fastening the pillar portions 13 and the foundation beam 10 together. These drawings show a portion where a pillar 82 positioned at the middle of the left-side front pillar block 72 and the front-side foundation beam block 12 are coupled together. In the drawings, a rectangular support plate 84 is fastened by welding to the lower end of the pillar 82 that has a channeled-shape in cross section. The support plate 84 is fastened to side beam 26 and support plate 20 using bolts and nuts; i.e., the pillar 82 is removably fastened onto the foundation beam 10.

To the upper end of the pillar portions 13 secured to the foundation beam 10 is further removably fastened a ceiling beam 15 that has a substantially rectangular shape as shown in FIG. 15 by similar fastening means. Onto the ceiling beam 15 is removably secured a roof 17 (see FIG. 5). Thus, the assembly body 11 mentioned earlier is constructed on the foundation beam 10, and the assemblable structural body 6 mentioned earlier is constituted by the foundation beam 10 and the assembly body 11 (see FIGS. 2 to 4). Suitable wall members are mounted on both side portions and rear portion of the pillar portions 13, thereby to form both side walls and rear wall. It is desired that these wall members are constituted by a blind or the like that holds visibility to some extent. This permits the pallet 8 that moves up and down to be seen from outside the assemblable structural body 6, that is advantageous in safety.

Figure 2:
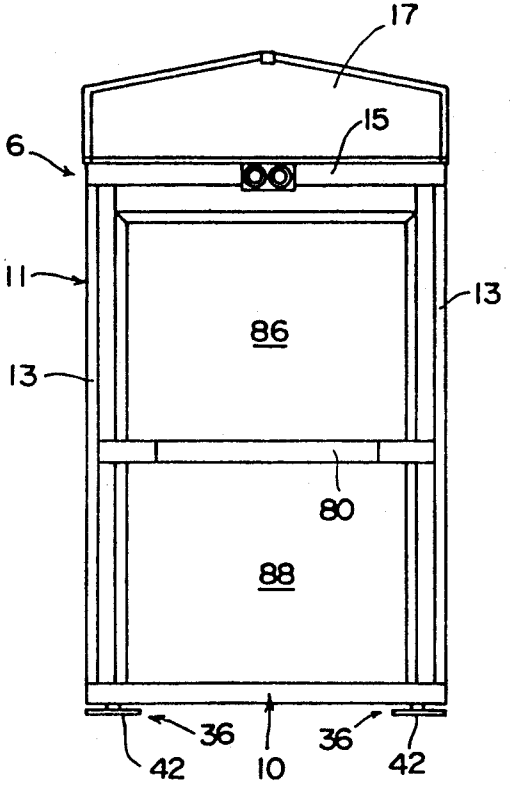
FIG. 2 is a front view schematically showing the place-on type assemblable structure shown in FIG. 1.

In the front end of the assemblable structural body 6 are formed space that is surrounded by the foundation beam 10 and the assembly body 11, and that has openings 86 and 88 (see FIG. 2). The front openings 86 and 88 are partitioned by the front intermediate beam 80 of pillar portions 13. When the assemblable structural body 6 is placed on the surface of the ground, the front intermediate beam 80 is positioned just under the floor portion 2F of the structure 2 for parking vehicles (see FIG. 1) without upwardly protruding. Therefore, the front opening 86 is positioned at the second floor portion and the front opening 88 is positioned at the first floor portion.

In the inside space of the assemblable structural body 6 is supported a pallet 8 to move up and down between the first floor and the second floor by pallet drive/support means 90 that is provided in the assembly body 11.

Figure 18:
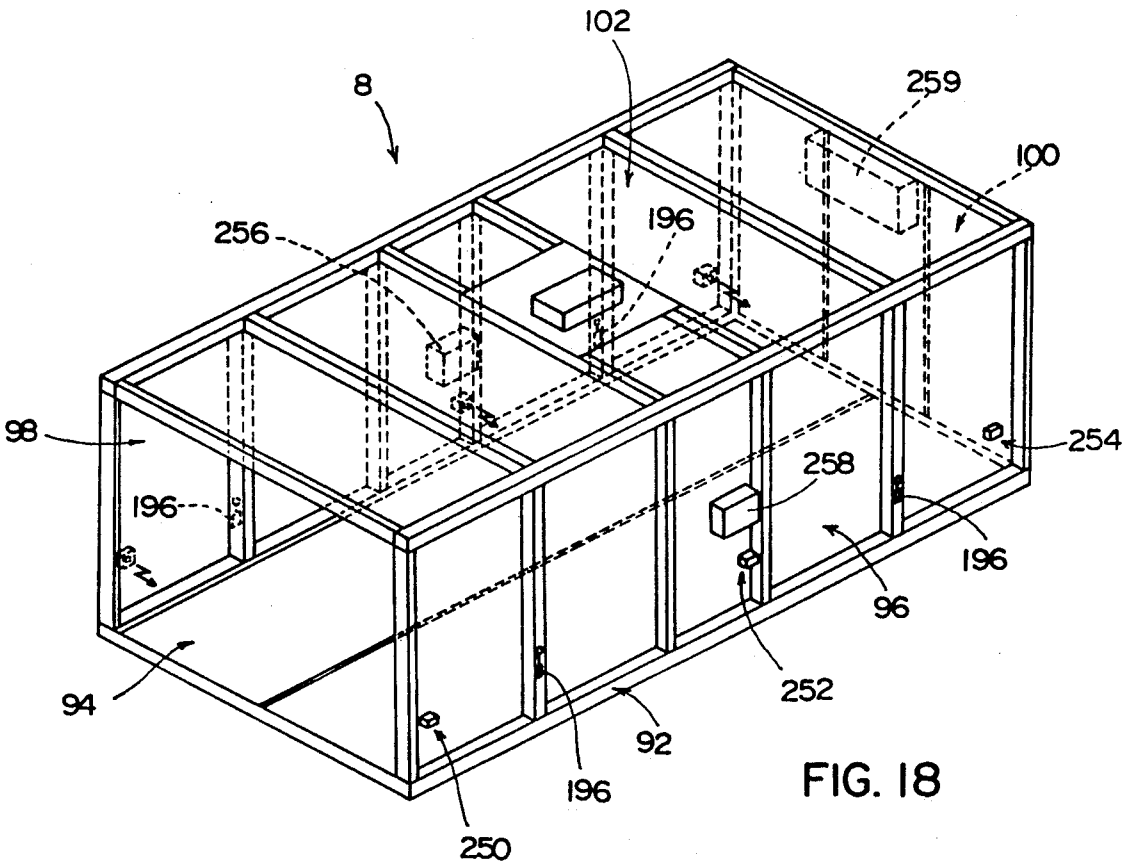
FIG. 18 is a perspective view schematically showing a pallet according to the above-mentioned embodiment.

As shown in FIGS. 5 and 18, the pallet 8 is composed of a floor portion 94 provided on a substantially rectangular foundation beam 92, side wall portions 96, 98 and rear wall portion 100 provided between to the pillar members that are secured onto both side portions and the rear portion of the foundation beam 92, and a ceiling portion 102 provided on the pillar members. An opening is formed in the front of the pallet 8.

Figure 19:
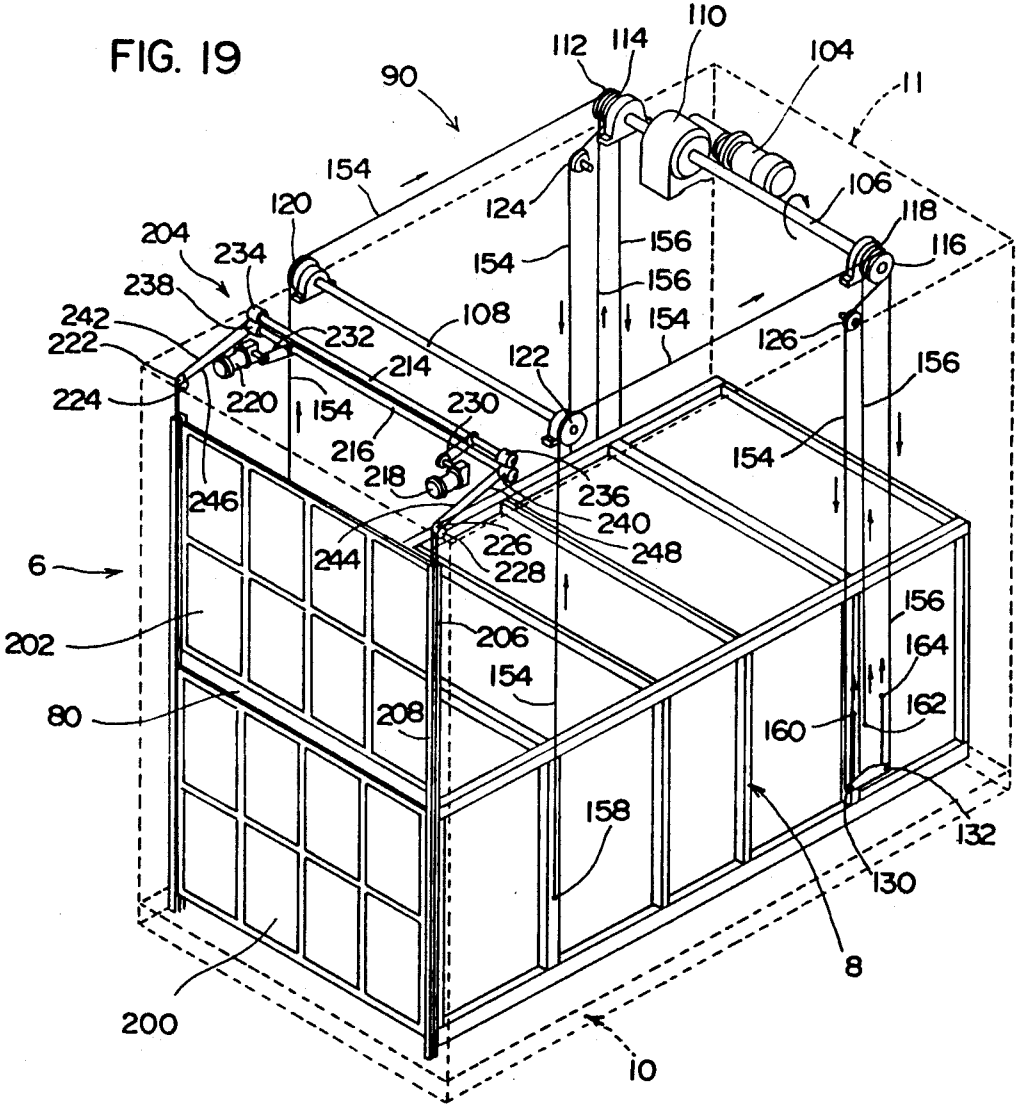
FIG. 19 is a perspective view schematically showing means which supports and drives the pallet and the shutter according to the above-mentioned embodiment.
Figure 21:
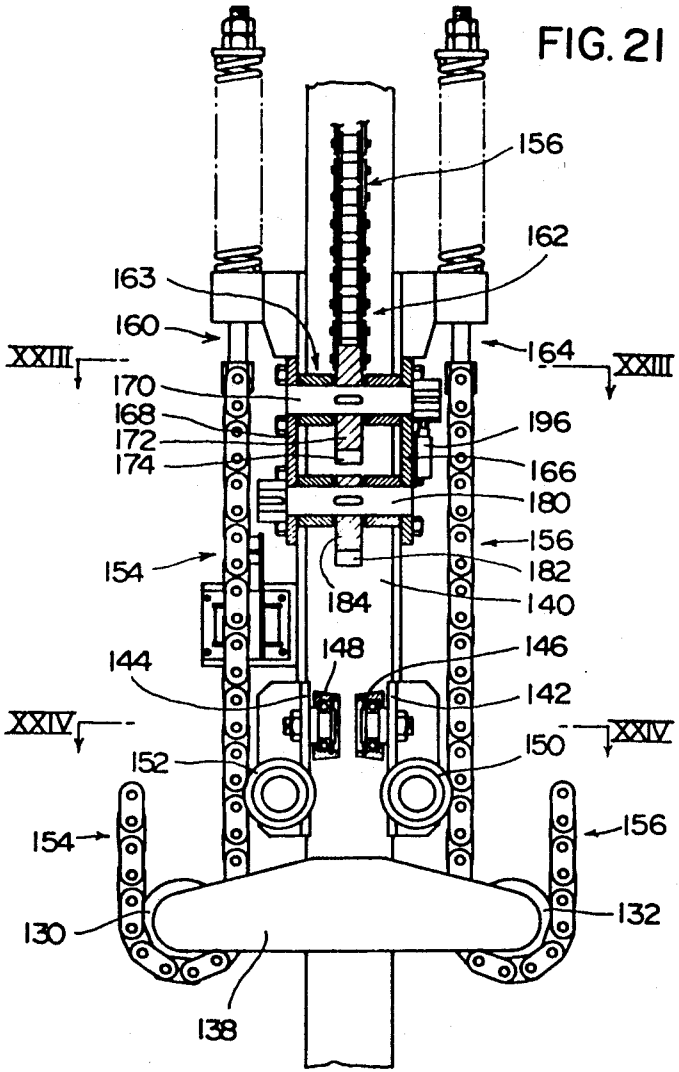
FIG. 21 is a front view, partly broken away, of FIG. 20.
Figure 20:
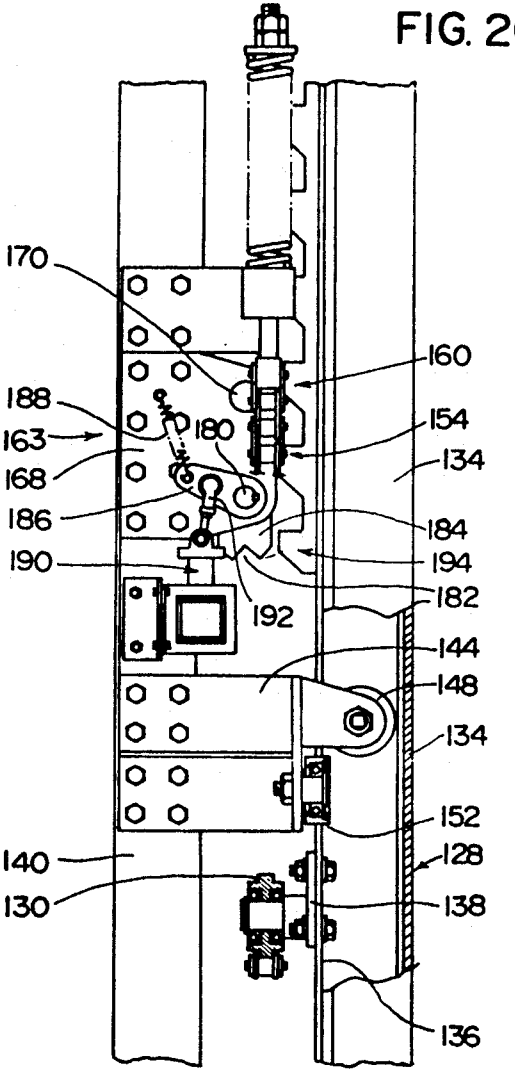
FIG. 20 is a side view showing, partly broken away, means for supporting and driving the pallet.

As shown in FIG. 19, the pallet drive/support means 90 provided in the assembly body 11 is supported at the rear portion of the ceiling beam 15 (see FIG. 15) that constitutes part of the assembly body 11, and includes a drive shaft 106 that is arranged to extend up to both ends thereof in the lateral direction and is driven by a drive motor 104, and a driven shaft 108 that is supported at the front portion of the ceiling beam 15 and is arranged substantially in parallel with the drive shaft 106. A reduction gear 110 is provided between the drive motor 104 and the drive shaft 106.

At both ends of the drive shaft 106 are provided two drive sprockets 112, 114 and two drive sprockets 116, 118, respectively, so as to rotate together with the drive shaft 106. At both ends of the driven shaft 108 are provided driven sprockets 120 and 122 so as to rotate together with the driven shaft 108.

Intermediate sprockets 124 and 126 are rotatably provided at positions between the drive shaft 106 and the driven shaft 108 but close to the drive shaft 106.

The drive shaft 106 and the driven shaft 108 have the right and left ends that have the substantially same constitution. Hence, for easy comprehension, only the right-side portion of the assembly body 11 as viewed from the front of FIG. 19 will be described by reference to FIG. 19 as well as FIGS. 20 to 24.

Figure 24:
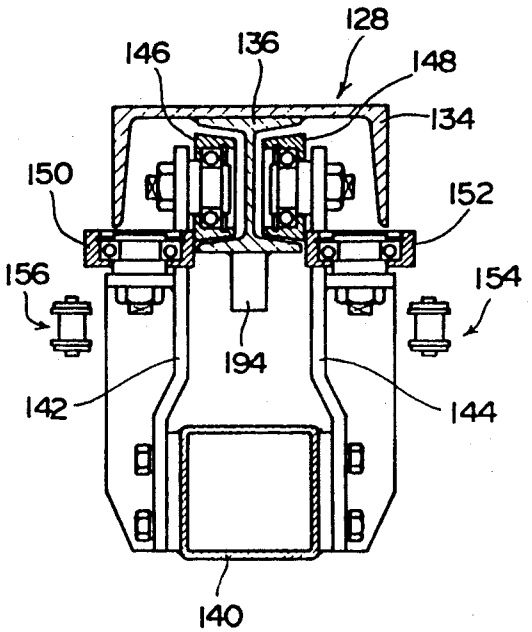
FIG. 24 is a sectional view taken along the line XXIV—XXIV of FIG. 21.
Figure 23:
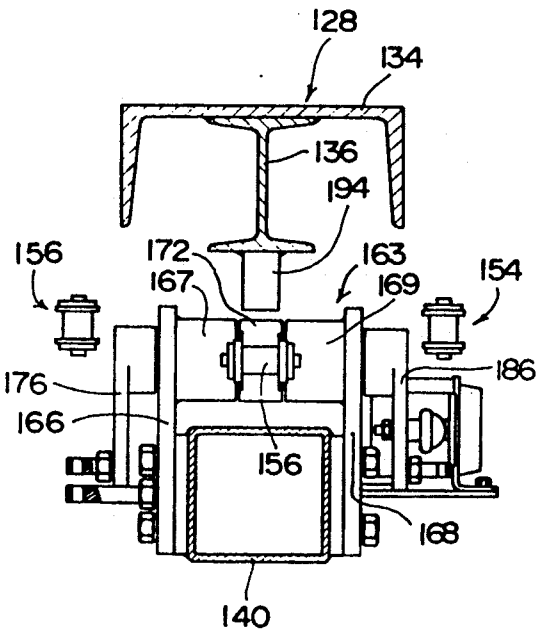
FIG. 23 is a sectional view taken along the line XXIII—XXIII of FIG. 21.
Figure 22:
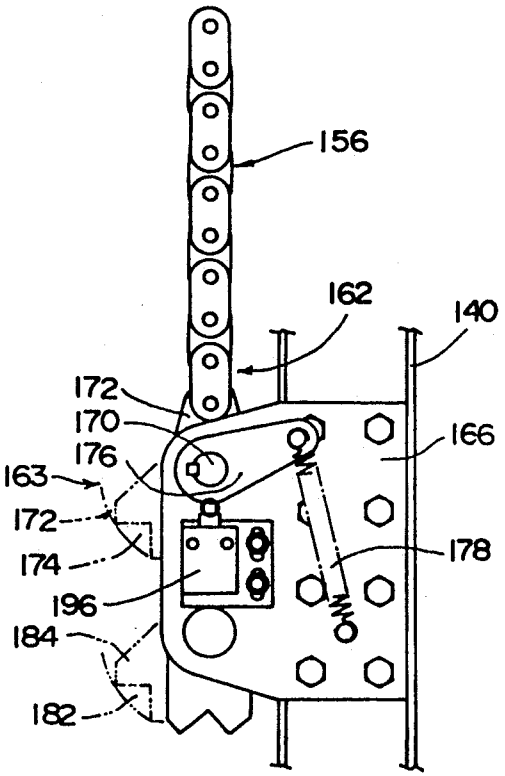
FIG. 22 is a right-side view showing a portion of FIG. 21.

Two reversing prockets 130 and 132 are rotatably provided (see FIGS. 20 and 21) to a pillar 128 that is located on a side wall portion constituting a part of the assembly body 11 and under the drive sprockets 116, 118 and the intermediate sprocket 126. As shown in FIGS. 23 and 24, the pillar 128 consist a pillar 134 having a channeled-shape in cross section and an I-beam 136. The I-beam 136 is secured by welding to the inside of the pillar 134 having the channeled-shape in cross section. To the inside end of the I-beam 136, a support plate 138 is attached at right angles thereto, the reversing sprockets 130 and 132 are rotatably supported by shafts that are fastened to both ends of the support plate 138.

A pillar 140 having a box shape in cross section is provided at the side wall portion of the pallet 8 at a position faced to the pillar 128, and a pair of support plates 142 and 144 (see FIG. 24) are attached to both sides of the pillar 140. The ends of the support plates 142 and 144 extend to both side portions of the I-beam 136 within the channel-shaped cross section of the pillar 134. To the above ends are fastened shafts that extend toward both sides of the I-beam 136, and guide rollers 146 and 148 are rotatably supported by these shafts. The guide rollers 146 and 148 are engaged with both sides of the I-beam 136 so as to rotatingly move along recessed portions formed between both sides of the I-beam.

The support plates 142 and 144 are further provided with support pieces at positions this side of the ends thereof at right angles therewith and in a direction to separate away from each other. Guide rollers 150 and 152 are rotatably supported by the shafts that are fastened to the above support pieces. The guide rollers 150 and 152 are so positioned as to hold therebetween both protruded ends of the inner side (pallet 8 side) of the I-beam 136 so as to rotatingly move along both protruded ends.

These guide roller means are provided also at the portions of a lifting drive end 158 of a chain 154 that will be described later, and by these guide roller means the pallet 8 is prevented from swinging in the back and forth or right and left directions, and is allowed to move up and down smoothly.

Two independent chains 154 and 156 engage with the drive sprockets 116 and 118, respectively.

The lifting drive end 158 that is one end of the chain 154 stretches forwardly from the drive sprocket 116, engages with the driven sprocket 122, stretches downwardly, and is coupled to the side wall portion of the pallet 8. A lifting driven end 160 which is the other end of the chain 154 stretches forwardly and reversely from the drive sprocket 116, engages with the intermediate sprocket 126, stretches downwardly, engages with the reversing sprocket 130, stretches upwardly, and is coupled to the pillar 140 of the pallet 8.

Further, a lifting drive end 162 that is one end of the other chain 156 stretches downwardly from the drive sprocket 118 and is coupled to the pillar 140 of the pallet 8 via support means 163. A lifting driven end 164 that is the other end thereof extends downwardly from the drive sprocket 118, engages with the reversing sprocket 132, upwardly stretches, and is coupled to the pillar 140 of the pallet 8.

Support means 163 is fastened to both sides of the pillar 140 in the back-and-forth direction and includes a pair of support plates 166 and 168 that extend in parallel toward the I-beam 136, a shaft 170 rotatably supported between the support plates 166 and 168, and a block 172 secured to a central portion of the shaft 170. The shaft 170 is supported by collar bearings 167 and 169 that are fastened to the support plates 166 and 168 in a direction opposed to each other. The upper end of the block 172 is coupled to the lifting drive end 162 of the chain 156, and the lower end thereof has teeth 174.

The shaft 170 has a lever 176 at its end portion, and a spring 178 is provided between the lever 176 and the support plate 166. The spring 178 exerts on the shaft 170 the rotational force by which the teeth 174 of the block 172 are protruded (rotated) toward the I-beam 136.

Another shaft 180 is rotatably supported under the shaft 170 and between the support plates 166 and 168 in the same constitution as above. To the central portion of the shaft 180 is fastened a block 184 that has teeth 182 formed at the lower end portion thereof. The shaft 180 has a lever 186 provided at its end portion, and a spring 188 is provided between the lever 186 and the support plate 168. The spring 188 exerts on the shaft 180 the rotational force by which the teeth 182 of the block 184 are protruded toward the I-beam 136.

The pillar 140 is provided at a position under the lever 186 with a solenoid 190 which is coupled to the lever 186 via a joint 192. The solenoid 190 has spring means which exerts on the lever 186 via joint 192 a force in a direction opposed to the spring 188. Therefore, the teeth 182 of the block 184 are usually held at a low position. When the operation circuit of the solenoid 190 is turned on, the solenoid moves whereby the block 184 is turned together with the shaft 180 via lever 186 overcoming the force of the spring 188, so that the teeth 182 thereof are outwardly protruded.

The I-beam 136 has, at a position opposed to the pillar 140, a plurality of fixed teeth 194 with which will engage (intermesh) the teeth 174 and 182 of the blocks 172 and 184 over a range in which these blocks 172 and 184 move in the up-and-down direction. As shown in the drawings, the teeth 174 and 182 of the blocks 172 and 184 have a substantially right-angled recessed shape, and the fixed teeth 194 have a similar protruded shape.

A limit switch 196 for detecting the chain breakage is provided at a position under the shaft 170 of the support plate 166 and is engaged with a recessed portion formed at the base end of the lever 176 so as to be actuated by the turning of the shaft 170. In case the chain 156 breaks, the block 172 turns together with the shaft 170 by the spring 178, and the teeth 174 thereof protrude outwardly. This causes the limit switch 196 to be turned on, whereby the operation circuit of the drive motor 104 is turned off and the operation circuit of the solenoid 190 is turned on.

The above-mentioned limit switch and solenoid are also provided at a portion of the lifting drive end 158 of the chain 154.

In the above-mentioned device 90 for driving and supporting the pallet 8, when the drive shaft 106 is rotated by the drive motor 104 in the direction of arrow in FIG. 19, the chains 154 and 156 are moved in the directions of arrows, and the pallet 8 ascends being pulled by the lifting drive ends 158 and 162 that are coupled to both sides of the pallet 8. When the drive motor 104 rotates in the reverse direction, the operation is carried out reversely and the pallet 8 descends.

Figure 25:
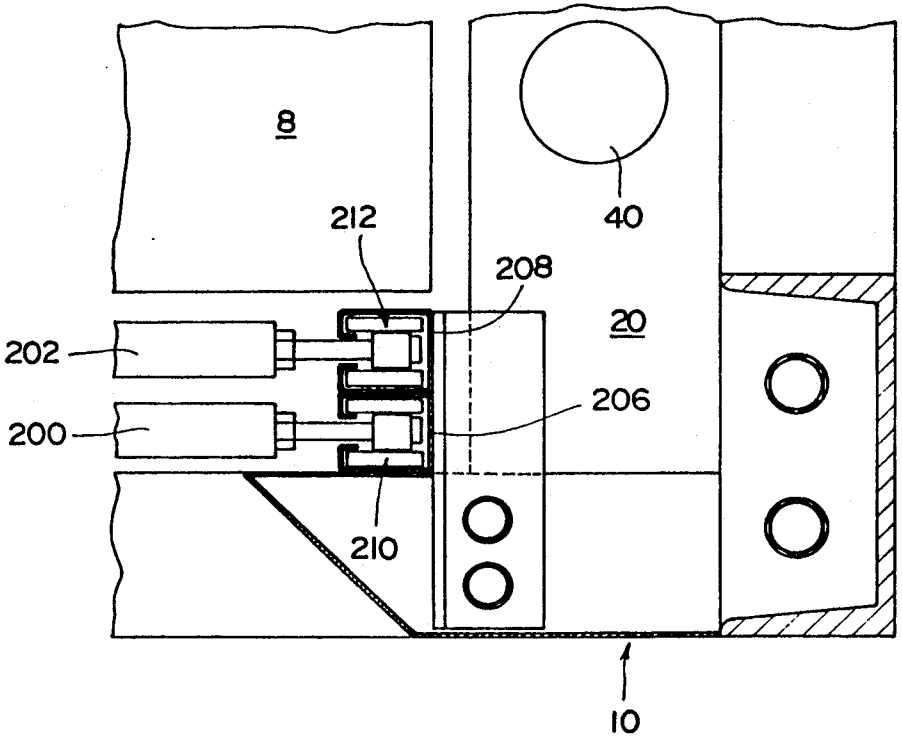
FIG. 25 is a sectional view schematically showing a guide portion of the shutter according to the above-mentioned embodiment.
Figure 26:
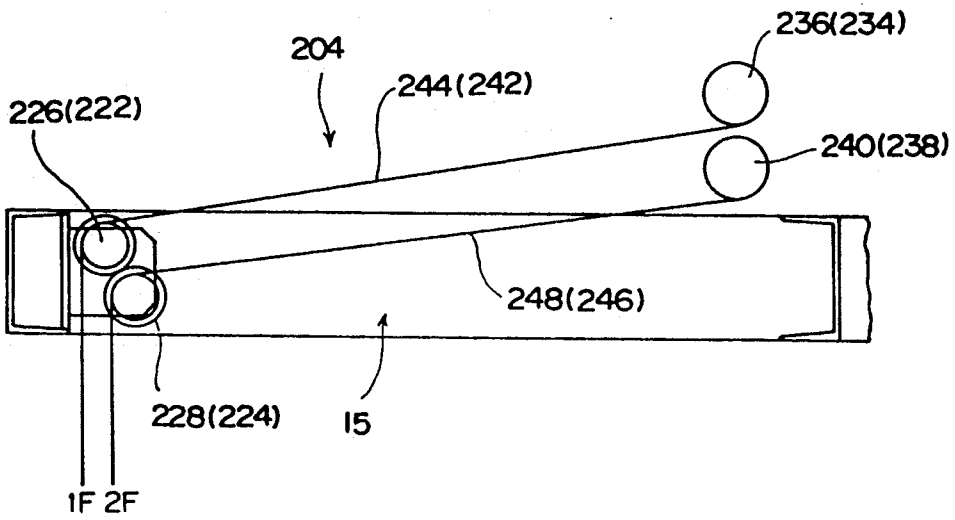
FIG. 26 is a schematic view of when means for supporting and driving the shutter shown in FIG. 19 is seen from a side direction.

In FIGS. 19, 25 and 26, two pieces of shutters 200 and 202 are supported at the front openings of the assemblable structural body 6 so as to be opened and closed by a shutter drive/support device 204 provided for the assembly body 11.

Referring to FIG. 25, two guide rails 206 and 208 are provided on both sides (only one side is shown in the drawing) of the front openings in the vertical direction and in the back-and-forth direction. On both sides of the shutters 200 and 202 are provided guide rollers 210 and 212 (only one side is shown in the drawing). The guide roller 210 of the shutter 200 positioned in front engages with the guide rail 206 and the guide roller 212 of the shutter 202 positioned at the back engages with the guide rail 208 to move up and down along the guide rails. The shutter 200 works to open and close the first-floor opening 88 (see FIG. 2) and the shutter 202 works to open and close the second-floor opening 86 (see FIG. 2).

The shutter drive/support device 204 includes drive shafts 214 and 216 that extend up to both ends in the lateral direction of the ceiling beam 15 and that are arranged in parallel and in an up-and-down relationship in front of the ceiling beam 15, drive motors 218 and 220 for driving the drive shafts 214 and 216, and rollers 222, 224 and 226, 228 that are rotatably supported at the front ends of both sides of the ceiling beam 15.

The motors 218, 220 and the drive shafts 214, 216 are coupled together via known chain means 230 and 232. Winches 234, 236 and 238, 240 are fastened to both ends of the drive shafts 214 and 216.

Wires 242 and 244 are provided between the winches 234, 236 and the shutter 200 that works on the opening and closing of the first-floor opening 88. The wires 242 and 244 are fastened at their ends to the winches 234 and 236, and are taken up or are taken off along the spiral grooves formed in the outer peripheral surfaces of the winches 234 and 236. The wires 242 and 244 extend forwardly from the winches 234 and 236, extend downwardly via grooves in the outer peripheries of the rollers 222 and 226, and are coupled at their other ends to upper positions on both sides of the shutter 200.

Wires 246 and 248 are provided between the shutter 202 that works on opening and closing of the second-floor opening 86 and the winches 238, 240. The wires 246 and 248 are fastened at their ends to the winches 238 and 240, and are taken up or are taken off along the spiral grooves formed in the outer peripheral surfaces of the winches 238 and 240. The wires 246 and 248 extend forwardly from the winches 238 and 240, extend downwardly via grooves in the outer peripheries of the rollers 224 and 228, and are coupled at their other ends to upper positions on both sides of the shutter 202.

By operation of the motors 218 and 220, the shutters 200 and 202 are lifted up or down independently of each other. Concrete operation will be obvious from FIG. 19 and other drawings, and is not further described here.

Described below are electric parts such as switches provided for the pallet 8 and the assembly body 11.

Referring to FIG. 18, pairs of photoelectric tube switches 250, 252 and 254 are provided on both sides at the front and rear portions and at the central portions in the pallet 8, each of the photoelectric tube switches being constituted by a switch of the light-projecting side and a switch of the light-receiving side. The photoelectric tube switches 250 and 254 at both ends work to confirm the position of the vehicle. When the light is shut off, the circuit for driving the motor 104 that drives the pallet 8 is turned off, and the pallet 8 stops moving even when it is under the ascending or descending motion. The photoelectric tube switches 252 at the central portion detect whether the vehicle is in the pallet or not.

Further, the pallet 8 has the limit switches 196 for detecting chain breakage provided at four places on its both sides. A pair of operation boxes (switch boxes) 256 and 258 are provided on both sides of the pallet 8 near the central portion in the back-and-forth direction. The operation boxes 256 and 258 are located at positions where they can be manipulated by the driver in the car and are each equipped with, for example, ten keys, descend-to-first-floor button, ascend-to-second-floor button, interphone, emergency stop button and the like. In order to ensure safety in the operation and to prevent mischievous operation, the ten keys consist of push buttons marked with numbers 0 to 9, and the pallet 8 can be moved up or down after combinations of these numerals are obtained.

A sign board 259 is provided at an upper portion on the rear wall in the pallet 8. The sign board 259 will display, for example, "Go ahead", "Stop", "Go back", "Pull hand brake and stop engine", "Ascending", "Descending", "Incoming OK", "Go out, please", etc., to give pertinent instructions to the driver depending upon the situations.

Referring to FIG. 15, a second-floor signal board 260 and a first-floor signal board 262 are provided on the ceiling beam 15 and on the intermediate beam 80 at the front end, respectively, in the front openings of the assembly body 11. The signal boards let the driver know whether he is allowed to drive into the pallet 8 from the floor where he is now on. Further, photoelectric tube switches 264 and 266 are provided at both ends in the front openings on the first floor and on the second floor, each of the photoelectric tube switches being constituted by a switch of the light-projecting side and a switch of the light-receiving side. When the light is shut off in the photoelectric tube switches 264 or 266, the circuits for operating the motors 218 and 220 that drive the shutters 200 and 202 are turned off, and the shutters 200 and 202 stop moving even when they are under the ascending or descending motion.

Limit switches 268 and 270 are provided on the ceiling beam 15 to turn on or off the circuit that operates the motors 218 and 220 which drive the shutters 200 and 202. The limit switches 268 and 270 are provided to specify the upper (second floor) stop position and the lower (first floor) stop position of the shutters 200 and 202. Cams which are rotated at a reduced speed of the revolution of the drive motors 218 and 220, act upon the limit switches 268 and 270 being corresponded to the above stop positions, such that the circuits for operating the drive motors 218 and 220 are turned off.

Stop switches 272 and 274 are provided at first-floor and second-floor on one side of the pillar portion 13 to control the positions at which the pallet 8 comes into halt on the first floor and on the second floor.

The stop switch 272 at the first floor consists of four switches (1) to (4) arranged downwardly in this order so as to be operated being engaged with the switch operation portion of the pallet 8.

The switch (1) is a half reduction switch, and when turned on, the descending speed of the pallet 8 is reduced into half. The switch (2) is a stop switch for stopping the drive motor 104. When turned on, the switch (2) turns off the circuit that operates the drive motor 104, and further causes the drive shaft of the drive motor 104 to be tightened by a brake device such as a band brake that is not shown, so that half-braking is applied.

The switch (3) is a lock switch for locking the drive motor 104. When turned on, the switch (3) works to completely lock the drive shaft of the drive motor 104 by the action of the above band brake, so that the drive motor 104 is forcibly brought into halt. Therefore, the pallet 8 stops descending.

The switch (4) is an overrun prevention switch which operates when the pallet 8 has descended in excess of the predetermined position and serves to secure safety in case the switch (3) fails to operate. When turned on, this switch (4) causes the drive shaft of the drive motor 104 to be completely locked by the band brake just like the above-mentioned switch (3), so that the drive motor 104 is forcibly brought into halt. Consequently, the pallet 8 stops descending.

The stop switch 274 at the second floor consists of four switches (1) to (4) arranged upwardly in this order so as to be operated being engaged with the switch operation portion of the pallet 8. These switches are successively operated with the ascending motion of the pallet 8, and their functions are substantially the same as those of the stop switch 272 of the first floor and are not described here again.

Call switches 273 and 275 are provided at right end portions in the front openings on the first floor and on the second floor. The call switches 273 and 275 are each equipped with ten-key switch, ascend-to-second-floor button, descend-to-first-floor button, etc. like those mentioned earlier.

Operation of the thus constituted embodiment of the invention will be now described.

As shown in FIG. 1, the place-on type assemblable structure 4 for lifting up and down vehicles is placed on an area of the structure 2 for parking vehicles. Described first is characteristic steps for placing the place-on type assemblable structure 4.

The primary step for assembling and placing the place-on type assemblable structure 4 on a predetermined position on the surface of the ground consists of the operation for marking the positions for placing the foundation beam 10. After predetermined placing positions are marked on the surface of the ground, there are assembled front-side foundation beam block 12, rear-side foundation beam block 14, and intermediate beams 16 and 18 near the above positions, thereby to set the foundation beam 10 (see FIG. 6). As shown in FIGS. 9 and 10, the foundation beam 10 is supported by castors 52 to move on the surface G of the ground. Then, the foundation beam 10 is moved to the predetermined position using the castors 52.

Thereafter, operation members 38 of jack means 36 are operated to extend the jack means 36. The foundation beam 10 is supported on the surface G of the ground via base plates 42 (see FIGS. 11 and 12). The foundation beam 10 is adjusted for its level by extending and contracting the jack means 36 using operation members 38 to meet the grade of the surface G of the ground. This enables the foundation beam 10 to be placed at a predetermined position on the surface of the ground such that the upper surface thereof becomes substantially flat or horizontal.

The assembly body 11 is assembled on the foundation beam 10, the pallet 8 is supported therein maintaining the freedom of ascending and descending, and shutters 200 and 202 are supported maintaining the freedom of ascending and descending in the front openings of the assembled structure that is composed of the foundation beam 10 and the assembly body 11. There are further mounted various devices such as pallet drive/support means 90, shutter drive/support means 204, and electric parts that are mentioned earlier. The procedure of assembly is carried out in compliance with any suitable conventional manner.

As described above, the place-on type assemblable structure 4 for lifting up and down vehicles is placed within an area of the structure 2 for parking vehicles (see FIG. 1).

Next, described below is the operation of the place-on type assemblable structure 4 for lifting up and down vehicles. The shutter of the floor where the pallet 8 is positioned is controlled to open the opening.

First, described below is the sequence of operation of the case where the pallet 8 is positioned on the first floor and the vehicle is to be moved from the first floor to the second floor (see FIGS. 15, 18 and 19).

The shutter 200 of the first floor ascends to the second floor so that the first floor is open. The signal board 262 of the first floor is exhibiting blue color. The car is driven forward to enter into the pallet 8 and is stopped at a predetermined position. After having confirmed "Incoming OK" on the sign board 259, the driver operates the operation box 258 to specify the second floor. The shutter 200 of the first floor descends to close the first floor. The pallet 8 ascends to the second floor and stops at the predetermined position. The shutter 202 of the second floor descends to open the second floor. After having confirmed "Go out, please" on the sign board 259, the car is moved back to go out onto the second floor portion 2F of the structure 2 for parking vehicles.

Next, described below is the case where the pallet 8 is positioned on the first floor and the vehicle is to be moved from the second floor to the first floor.

The opening of the second floor has been closed by the two shutters 200 and 202. The signal board 260 of the second floor is exhibiting red color. The driver gets out of his car and operates the call switch 275 of the second floor to call the pallet 8 to the second floor. The shutter 200 of the first floor descends to close the first floor. The pallet 8 ascends to the second floor and stops at the predetermined position. The shutter 202 of the second floor opens. The car is driven forward to enter into the pallet 8 and is stopped at the predetermined position. Through the same operation and action as those mentioned above, the pallet 8 descends to the first floor and the car is allowed to go out.

In case, for example, the chain 156 is broken (see FIGS. 19 to 23) while the pallet 8 is under ascending or descending motion, the teeth 174 of the block 172 protrude to intermesh with the fixed teeth 194 and the motor 104 stops simultaneously. Furthermore, the teeth of another block 184 protrude similarly to intermesh with the fixed teeth 194. Owing to the above double safety means, the pallet 8 is reliably prevented from falling down.

In the aforementioned embodiment, the vehicle moves forward to enter into the assemblable structure 6 and moves back to go out. The structure, however, may be so constituted that the vehicle moves forward to enter thereinto and further moves forward to get out therefrom.

The invention described above by way of embodiments brings about the following effects.

(1) The place-on type assemblable structure has the foundation beam which is placed on the surface of the ground via jack means and of which the level is adjusted by extending and contracting jack means. Therefore, the level can be adjusted easily and reliably without the need of leveling the ground with particularly strict accuracy.

Moreover, since the hole load is supported via jack means, there is obtained a stable place-on type assemblable structure that exhibits improved bearing power of the ground.

According to this invention, therefore, the place-on type assemblable structure can be simply and easily placed and reliably assembled with safety even on the surface of the ground that has been prepared relatively simply, and can, therefore, be widely utilized as a general structure with great advantage.

(2) When the foundation beam is provided with running means, the structure can be easily moved to a predetermined position to greatly facilitate the installation operation.

(3) When the place-on type assemblable structure is used for a structure for lifting up and down vehicles, its level can be easily and reliably adjusted without the need of preparing the ground with particularly strict accuracy. Moreover, the structure that exhibits excellent bearing power of the ground can be simply and reliably placed and assembled as part of the three-dimensional parking lot, maintaining safety to a sufficient degree.

(4) When the place-on type assemblable structure is used for a structure for lifting up and down vehicles and employs an intermediate sprocket for the pallet drive/-support means, it is allowed to increase the length over which the chain intermeshes with the drive sprocket, making it possible to obtain safe and reliable drive coupling.

(5) When the place-on type assemblable structure is used for a structure for lifting up and down vehicles and is equipped with double safety means against the breakage of chain, the pallet can be further reliably prevented from falling down, which results in markedly improved safety performance.

While the invention has been described in detail with reference to the embodiment, it should be understood that the invention is not limited to the above embodiment only, and various changes and modifications can be made without departing from the spirit and scope of the invention.

What we claim is:

1. A place-on type assemblable structure to be supported by an underlying surface, comprising:

a foundation beam;

an assembly body assembled on said foundation beam; and said foundation beam including a plurality of jack means which each have a lower end adapted for contact with the underlying surface, said jack means being individually adjustable in an up and down direction with respect to the underlying surface such that said foundation beam can be maintained essentially horizontal despite unevenness in the underlying surface.

2. A place-on type assemblable structure according to claim 1 wherein said foundation beam is essentially rectangular in shape and one of said jack means is positioned at each corner of said essentially rectangular foundation beam, and each of said jack means including a manually rotatable operation portion such that each of said jack means can be manually raised and lowered.

3. A place-on type assemblable structure as recited in claim 2 wherein said foundation beam includes two side beams, two end beams and a pair of lateral beams extending adjacent and parallel to a respective one of said end beams, and said plurality of jack means including jack means provided essentially at each intersection of said lateral beams and said side beams.

4. A place-on type assemblable structure of claim 1, wherein said jack means includes;

an operation member having external thread portions consisting of a right-hand thread and a left-hand thread, and a rotary operation portion;

said foundation beam including an internal thread portion extending vertically; and a base plate to be placed on the underlying surface; wherein said base plate has an internal thread portion that is formed to upwardly extend in the vertical direction; and wherein said external thread portion of said operation member engages with the internal thread portions of said foundation beam and of said base plate.

5. A place-on type assemblable structure of claim 1, wherein said jack means includes:

an operation member that has an external thread formed at a central portion thereof, a rotary operation portion at one end thereof, and a disk portion at the other end thereof;

said foundation beam including an internal thread portion formed to extend vertically; and a base plate to be placed in contact with the underlying surface; wherein a portion for accommodating and supporting said disk portion is formed on said base plate; and said external thread of said operation member is in engagement with said internal thread portion of said foundation beam, and said disk portion is rotatably accommodated and supported in said accommodation/support portion of said base plate.

6. A place-on type assemblable structure of claim 1, wherein said foundation beam is provided with a plurality of running means to facilitate movement of said foundation beam, and, when said jack means are in a contracted condition, said foundation beam is movably supported on the underlying surface by said running means.

7. A place-on type assemblable apparatus for lifting up and down vehicles, said apparatus being supported by an underlying surface and forming an independent component of a vehicle parking structure with first and second floors, said apparatus comprising;

an assemblable structure in contact with the underlying surface;

a pallet supported within said assemblable structure and adapted for up and down movement within said assemblable structure between the first and second floors of the vehicle parking structure;

said assemblable structure including a foundation beam and an assembly body which is assemblable on and secured to said foundation beam, and said foundation beam including a plurality of jack means in contact with the underlying surface, each of said jack means being independently adjustable in an up and down direction with respect to the underlying surface such that said foundation beam can be maintained essentially horizontal despite unevenness in the underlying surface.

8. A place-on type assemblable apparatus of claim 7, wherein said foundation beam includes a front portion, a rear portion and first and second side portions, said assembly structure including pillar portions that are fastened to said foundation beam and that upwardly extend from both side portions and the rear portion of said foundation beam, a ceiling beam supported on said pillar portions, and a roof supported on said ceiling beam;

said pillar portions have wall members attached thereto thereby to form both side walls and a rear wall;

said assemblable structure has space with openings in front as defined by the front portion of said foundation beam and an attached portion of said assembly structure;

pallet drive/support means supported by said assembly structure for lowering and raising said pallet between the first and second floors;

said pallet including a floor portion, a pair of side walls, a rear wall, a ceiling portion and a front section with openings;

two shutters which are supported at said front sections of said assemblable structure so as to individually open and close the front openings of said pallet at the first floor and the second floor; and shutter drive/support means provided in said assembly body for raising and lowering said shutters.

9. A place-on type assemblable apparatus of claim 8, wherein:

said pallet drive/support means includes a drive shaft that is driven by a drive motor, said pallet drive/support means further including a drive shaft arranged at an opposite end of said assemblable structure essentially in parallel with said drive shaft;

two drive sprockets are provided at each end of said drive shaft;

one driven sprocket is provided at each end of said driven shaft;

first and second intermediate sprockets are provided at opposite sides of said assemblable structure and at a position between said two shafts but closer to respective pairs of said drive sprocket;

two reversing sprockets are provided on each side wall of said pillar portions under said drive sprockets and said intermediate sprocket;

two independent chains intermesh with two drive sprockets at each end of said drive shaft;

a first of said chains has a lifting drive end that downwardly extends from one of said drive sprockets via one of said driven sprockets and is coupled to a first of said side walls of said pallet, and said chain also including a lifting driven end that reversely extends from one of said drive sprockets, downwardly extends via the intermediate sprocket, further extends upwardly via said reversing sprocket, and is coupled to said one of said side walls of the pallet; and a second of said chains has a lifting drive and that downwardly extends from a second one of said drive sprockets and is coupled to said first side wall of said pallet, and said second chain having a lifting driven end that downwardly extends from the second of said derive sprockets, upwardly extends via a second one of said reversing sprockets, and is coupled to the first side wall of the pallet.

10. A place-on type assemblable apparatus of claim 9, wherein:

a pair of locking shafts are rotatably supported maintaining a distance in an up-and-down direction, said pair of locking shafts horizontally extending on an outside portion of said pallet at positions opposed to said lifting drive ends of said chains;

a block having teeth formed at a lower end thereof is secured to each of said pair of locking shafts;

said lifting drive end of said chain is coupled to an upper end of said block;

first spring means is provided to produce a rotational force in a direction by which the teeth formed at the lower end of said block are biased outwardly away from said pallet;

a solenoid is further coupled to a lower one of said locking shafts;

said solenoid is provided with second spring means which exerts on said lower one of said locking shafts via said solenoid a rotational force in the direction opposed to the first spring means;

a pillar extending in a vertical direction is disposed at a portion of said assemblable structure facing said first side wall of the pallet where said block is provided;

a plurality of fixed teeth engageable with said teeth of said block is provided on said pillar at a position opposed to the side wall of the pallet over a range in which said block substantially moves in an up-an-down direction;

a limit switch is provided for the upper of said locking shafts so as to engage with said upper locking shaft and to be operated by the turn of said upper locking shaft;

when either said first or second chain is broken, said block of said upper locking shaft coupled to said chain rotates together with the upper locking shaft, whereby the teeth thereof engage with said fixed teeth provided on said pillar to prevent said pallet from dropping further, and said limit switch works to turn off the circuit for operation said drive motor and to turn on said solenoid operation circuit; and when said solenoid operation circuit is turned on, said solenoid causes said block to turn together with the shaft thereof, whereby the teeth thereof engage with said fixed teeth provided on said pillar of said assembly body to prevent said pallet from dropping.

11. A place-on type assemblable structures, comprising:

a foundation beam;

an assembly body assembled on said foundation beam;

a plurality of jack means for supporting said foundation beam essentially horizontally with respect to an underlying surface, each of said jack means including an operation member having external thread portions which include a right-hand thread and a left-hand thread and a rotary operation portion, said jack means further each including a base plate adapted for contact with the underlying surface, said base plate having an internal thread portion extending vertically, said foundation beam including an internal thread portion extending vertically, and said external thread portions of said jack means being in engagement with the internal thread portions of said foundation beam and said base plate.

12. A place-on type assemblable structure comprising:

a foundation beam;

an assembly body assembled on said foundation beam;

a plurality of jack means for supporting said foundation beam essentially horizontally with respect to an underlying surface, each of said jack means including an operation member having an external thread formed at a central portion thereof, a disk portion at an opposite end thereof and a base plate adapted for contact with the underlying surface, said base plate including an accommodating support portion which receives said disk portion, said foundation beam including an internal thread portion extending vertically, and said external thread of said operation member being in engagement with said internal thread portion of said foundation beam, and said disk portion being rotatably accommodated and supported in said accommodation/support portion.

* * * * *